US005794515A

United States Patent [19]

Bethke

[11] Patent Number: 5,794,515

[45] Date of Patent: Aug. 18, 1998

[54] SWASHPLATE CONTROL SYSTEM FOR AN AXIAL PISTON PUMP

[76] Inventor: Donald G. Bethke, 131 W. Oakwood Dr., Delafield, Wis. 53018

[21] Appl. No.: 825,762

[22] Filed: Apr. 3, 1997

[51] Int. Cl.[6] ..... F01B 29/00

[52] U.S. Cl. ..... 92/128; 92/12.2; 91/506

[58] Field of Search ..... 92/12.2, 71; 417/269; 91/504, 506

[56] References Cited

U.S. PATENT DOCUMENTS

| | | | |
|---|---|---|---|
| 2,177,097 | 10/1939 | Doe et al. | 91/506 |
| 3,106,057 | 10/1963 | Manning et al. | 91/506 |
| 3,396,536 | 8/1968 | Miller et al. | 92/12.2 |
| 3,682,044 | 8/1972 | Ankeny et al. . | |
| 3,733,963 | 5/1973 | Kubilos | 91/506 |
| 4,487,109 | 12/1984 | Burandt et al. | 91/506 |
| 4,493,189 | 1/1985 | Slater | 92/12.2 |
| 4,581,980 | 4/1986 | Berthold . | |
| 4,896,585 | 1/1990 | Forster | 92/12.2 |
| 5,253,576 | 10/1993 | Bethke . | |

*Primary Examiner*—Thomas E. Denion

*Attorney, Agent, or Firm*—Andrus, Sceales, Starke & Sawall

[57] ABSTRACT

An axial piston pump assembly includes a housing having an outer wall defining a generally cylindrical interior and an end wall. A drive shaft extends through the end wall is rotatably mounted in the housing for rotation on the axis of the cylindrical interior, and the rotor is attached to the drive shaft for rotation therewith. A plurality of circumferentially spaced, axially disposed cylinders is positioned in the rotor, and a series of axially reciprocable pistons is disposed in the cylinders. A swashplate surrounds the drive shaft and is mounted in the housing for tilting movement on a tilt axis transverse to the drive shaft axis. A planar reaction surface on the swashplate is engaged by the outer ends of the pistons. A biasing arrangement is provided for urging the piston ends into engagement with the reaction surface, and a control arrangement is supplied for tilting the swashplate on its axis to maintain the reaction surface angularly disposed with respect to the axis of the drive shaft. A pair of inboard trunnion blocks is adjustably attached to the interior of the housing end wall on opposite sides of the drive shaft and supports the swashplate on a rear surface opposite the reaction surface for tilting movement thereon. The control arrangement resides in a cooperating piston arrangement acting in opposed relationship against the reaction surface and the rear surface of the swashplate to eliminate the bending moments induced by the axially reciprocable pistons and biasing means about the tilt axis of the swashplate.

1 Claim, 6 Drawing Sheets

SWASHPLATE CONTROL SYSTEM FOR AN AXIAL PISTON PUMP

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention pertains to an axial piston fluid pump, and more particularly, to a pump having an improved swashplate control system which substantially reduce the stresses at the swashplate pivot point and enables a smaller, less expensive pump design.

Axial piston pumps are old and well known in the art. All such pumps include a swashplate or tiltplate against which the axial piston ends bear and around which such ends rotate with the angled reaction surface of the swashplate allowing a cyclic reciprocal movement of the pistons providing each cylinder with low-pressure intake and high-pressure discharge of hydraulic fluid on each rotation. The swashplate or tiltplate is journaled for rotation on a tilt axis transverse to the common axis of the drive shaft which drives the cylindrical rotor housing the pistons.

One example of such a pump is disclosed in U.S. Pat. No. 5,253,576 issued Oct. 19, 1993 to the inventor of this application. In this arrangement, a swashplate construction for an axial piston pump includes a pair of inboard trunnions providing bearing support for the swashplate, and a swashplate with a complementary concave bearing surface rotatably supported on the trunnions to provide tilting movement of the swashplate. Both the inboard trunnions and swashplate can be manufactured with stock materials and relatively simple machining techniques to provide accurate bearing surfaces. The entire pump is easily assembled through one end of the housing and final alignment of the trunnions with respect to the swashplate bearing surface can be made as a final pump assembly step.

The tilt portion of the swashplate is variably controlled by the various combination of reaction forces including a set of compression springs biasing the axial pistons, a volume control off-stroking piston and a pressure compensating on-stroking piston. The off-stroking and on-stroking control pistons are each anchored in the cover of the pump housing, and both bear against a reaction surface of the swashplate at opposite bearing points thereon outside the cluster of axial pistons. While this design has produced satisfactory results in many applications, the axial piston springs and the particular configuration of the control pistons creates a "teeter-totter" effect which tends to induce unreasonably high stresses and undesirable bending moments about the tilt axis or pivot point of the swashplate. Accordingly, the swashplate and the inboard trunnions must be of a larger than desired size to handle the forces caused by the axial piston springs and the control pistons in the prior art axial piston pump.

As a result, it is desirable to provide a swashplate control system for an axial piston pump which eliminates the bending moments normally created by the axial piston springs and the control pistons about the tilt axis of the swashplate. It is further desirable to provide an axial piston pump using a smaller, less expensive swashplate and inboard trunnions. It also remains desirable to provide an axial piston pump assembly which is easily manufactured and assembled.

BRIEF SUMMARY OF THE INVENTION

The improved swashplate control system of the present invention advantageously provides a lesser stressed and responsive axial piston pump which continues to offer precision alignment of the swashplate relative to the trunnion blocks. The control system has a unique construction which reduces loading over the swashplate and permits the use of smaller, more cost efficient pump components, such as a swashplate and its associated trunnions.

These and other aspects of the invention are realized in an axial pump assembly which includes a housing having an outer wall defining a generally cylindrical interior and an end wall, a drive shaft extending through the end wall and rotatably mounted in the housing for rotation on the axis of the cylindrical interior, a rotor attached to the drive shaft for rotation therewith, a plurality of circumferentially spaced axially disposed cylinders in the rotor, axially reciprocable pistons disposed in the cylinders, a swashplate surrounding the drive shaft and mounted in the housing for tilting movement on a tilt axis transverse to the drive shaft axis, a planar reaction surface on the swashplate which is engaged by the outer ends of the pistons, biasing means for urging the piston ends into engagement with the reaction surface, control means for tilting the swashplate on its axis to maintain the reaction surface angularly disposed with respect to the axis of the drive shaft, and a pair of inboard trunnion blocks adjustably attached to the interior of the housing end wall on opposite sides of the drive shaft and supporting the swashplate on a rear surface opposite the reaction surface for tilting movement thereon. The pump assembly is improved such that the control means takes the form of a cooperating control piston arrangement acting in opposed relationship on the reaction surface and the rear surface of the swashplate to eliminate bending moments induced by the axially reciprocable pistons and biasing means about the tilt axis of the swashplate.

In another aspect of the invention, an axial piston pump assembly includes a housing having an outer wall defining a generally cylindrical interior and an end wall, a cover plate attached to the outer wall of the housing, a drive shaft extending through the end wall and rotatably mounted in the housing for rotation on the axis of the cylindrical interior, a rotor attached to the drive shaft for rotation therewith, a plurality of circumferentially spaced axially disposed cylinders in the rotor, axially reciprocable pistons disposed in the cylinders, a swashplate surrounding the drive shaft and mounted in the housing for tilting movement on a tilt axis transverse to the drive shaft axis, a planar reaction surface on the swashplate which is engaged by the outer ends of the piston, biasing means for urging the piston ends into engagement with the reaction surface, control means for tilting the swashplate on its axis to maintain the reaction surface angularly disposed with respect to the axis of the drive shaft, and a pair of inboard trunnion blocks adjustably attached to the interior of the housing end wall on opposite sides of the drive shaft and supporting the swashplate on a rear surface opposite the reaction surface for tilting movement thereon.

The pump assembly is improved such that the control means includes a first piston positioned in the housing and bearing against the rear surface of the swashplate at a peripheral extremity thereof. A second piston is positioned in the housing radially outwardly of the axially reciprocable pistons and bears against a reaction surface of the swashplate at a peripheral extremity thereof in opposed relationship to the first piston. One of the first and second pistons has a first pressurized actuated surface area which is larger than a second pressurized actuated surface area on the other of the first and second pistons.

The invention also contemplates an improved method of assembling an axial piston pump having improved control pistons.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention.

In the drawings.

DETAILED DESCRIPTION OF THE INVENTION

Figure 2:
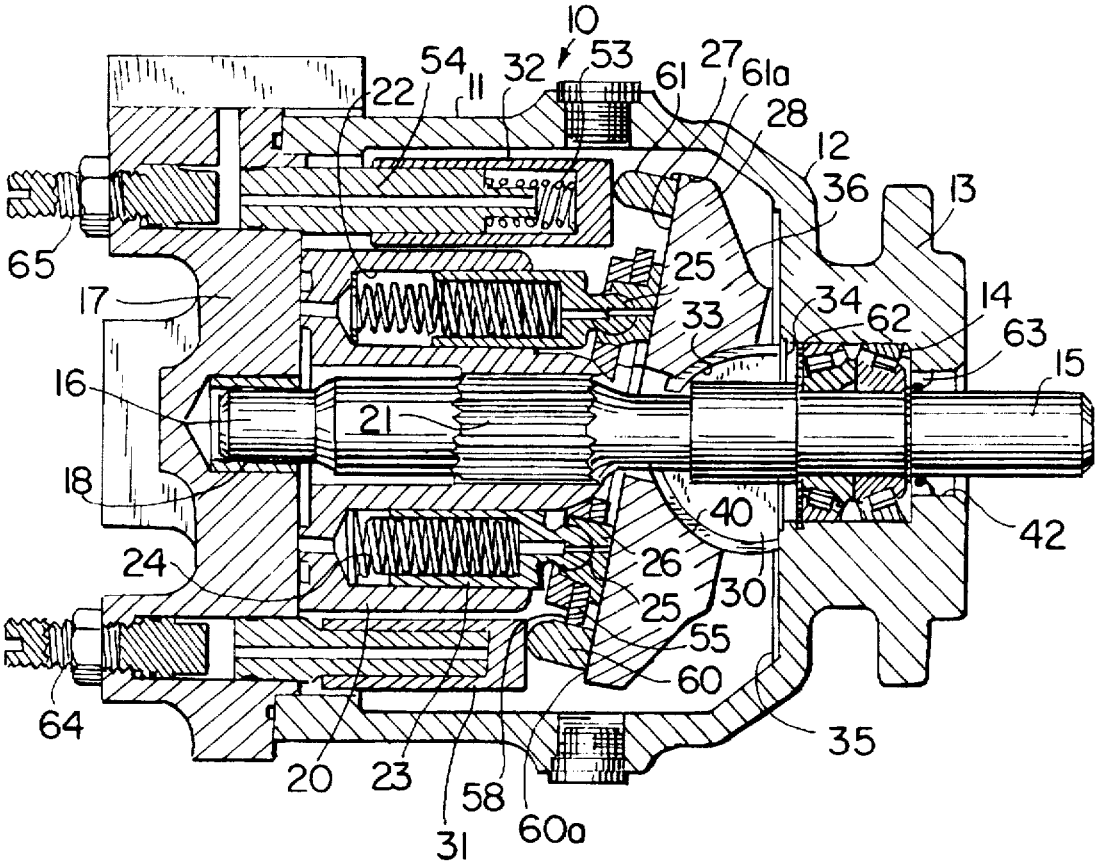
FIG. 2 PRIOR ART
FIG. 2 is a vertical section through an axial piston pump depicting a prior art swashplate control system.

Referring first to FIG. 2, an axial piston pump including a swashplate control system of the prior art includes a housing 10 made from a casting and including a generally cylindrical outer wall 11 and an integral end wall 12. The end wall 12 includes an axially disposed hub 13 which is bored to receive a tapered roller bearing assembly 14 to rotatably support one end of a drive shaft 15. The end of the drive shaft 15 extending outside the housing end wall 12 is typically provided with a pulley, coupling or direct drive for receiving a drive belt or drive shaft from a suitable source of motive powers, such as an electric motor. The other end of the drive shaft 15 is rotatably supported in a counter bore 16 in a cover plate 17. A suitable journal bearing 18 is disposed between the counter bore 16 and the drive shaft end.

A rotor assembly including a generally cylindrical rotor 20 is mounted for rotation on the drive shaft 15 by a suitable splined connection 21. The rotor includes a plurality of circumferentially spaced, axially extending cylinders 22 surrounding and parallel to the drive shaft. An axially reciprocable piston 23 is disposed in each cylinder 22. Each piston 23 is counter bored to receive one end of a compression spring 24, the opposite end of which is bottomed in the cylinder 22. The compression springs 24 together provide a biasing force urging the pistons 23 to extend out of their respective cylinders 22. The individual piston springs 24 could be eliminated and replaced with a single central spring which biases the entire rotor assembly and provides the necessary hold down. The outer ends of the pistons 23 are provided with balls 25 which are received for universal pivotal movement in shoes 26. Each shoe 26 has a flat surface **26*a* opposite the piston end which slidably engages a smooth flat reaction surface 27 on a swashplate 28**.

The swashplate 28 in turn is supported for tilting movement about an axis transverse to the axis of the drive shaft 15 on a pair of cylindrical trunnion blocks 30 mounted on the inside surface of the outer housing wall 11. The trunnion blocks 30 are made from short sections of cold rolled steel bar. Each trunnion block 30 has a semi-cylindrical outer surface 33 which is truncated by a milled flat 34 formed thereon. The trunnion blocks 30 are adapted to be mounted with the milled flats 34 against a flat inner surface 35 of the end wall 12. The trunnion blocks 30 are mounted on opposite sides of the drive shaft 15 with the common axis of rotation, defined by the semi-cylindrical surfaces 33, offset slightly from the axis of the drive shaft 15.

The swashplate 28 is provided on a rear surface 36 opposite the reaction surface 27 with a concave cylindrical bearing surface 40 having a diameter just slightly larger than the diameter of the semi-cylindrical surfaces 33 of the trunnion blocks 30. The swashplate bearing surface 40 bears on surfaces 33 of the trunnion blocks 30. The inboard mounting of the trunnion blocks 30 provides direct support to the rear surface 36 of the swashplate 28 in direct alignment with the rotational circle of the pistons 23. The concave bearing surface 40 is interrupted by a centrally disposed through hole 42 for passage of the drive shaft 15. The through hole 42 must be large enough to accommodate the full tilt angle of the swashplate 28 in operation and to also allow passage of the largest diameter portion of the drive shaft 15 (i.e. the splined portion 21) during assembly. The reaction surface 27 of the swashplate 28 may be variably tilted between a zero or no-stroke position in which the surface 27 is perpendicular to the axis of the drive shaft 15, and a maximum full-stroke position in which the reaction surface 27 is tilted, for example 5° to 20°, from its zero perpendicular position. The tilt position of the swashplate 28 is variably controlled by various combinations of reaction forces including the piston compression springs 24, a volume control off-stroking piston 31 and a pressure compensating on-stroking piston 32. These elements will be discussed in greater detail below.

The basic operation of the prior art pump may be briefly summarized as follows. As the drive shaft 15 is turned, as by an electric drive motor, the rotor 20 will turn with the drive shaft 15 because of its splined connection 21 thereto. The cover plate 17 includes an inlet from a low-pressure source of hydraulic fluid and an outlet from the pump for pressurized fluid, neither of which is shown in the drawing. As the shaft and rotor turn, the pistons 23 which rotate around the side of the pump served by the fluid inlet move axially outwardly against the reaction surface 27 of the swashplate 28 under the urging of the bias springs 24, thereby drawing fluid into the cylinders 22, such as the upper cylinder shown in FIG. 2. As pistons 23 continue to rotate toward the outlet side of the pump, they are cammed inwardly as a result of their sliding movement along the inclined reaction surface 27, thereby forcing hydraulic fluid under pressure from the cylinders 22. The volume of fluid drawn into the cylinders 22 and subsequently pumped under pressure therefrom depends on the angle at which the swashplate 28 is disposed. With maximum flow, as indicated above, the swashplate 28 is tilted to its maximum position. The foregoing description is generally common to the operation of all axial piston pumps.

Volume control in the pump of FIG. 2 is provided internally by the volume control piston 31, also referred to as the off-stroking piston because of its tendency to bias the swashplate 28 towards a no flow position, and the opposite control or pressure compensating piston 32 which is also referred to as an on-stroking piston and which is biased to tilt the swashplate 28 towards the full or maximum flow position of FIG. 2. The off-stroking piston 31 receives high-pressure system fluid from the pump outlet port through suitable porting (not shown), and the on-stroking piston 32 is similarly provided with pressurized fluid from the pump outlet port through porting (also not shown). It should be noted that the area on which the high-pressure fluid acts in the on-stroking piston 32 is greater (e.g. two times) that of the off-stroking piston 31, thereby normally forcing the swashplate 28 towards the maximum full-flow position. Pressure control may be provided externally of the pump with relief valve apparatus (not shown). The on-stroking piston 32 also includes an internal bias spring 53 extending between an adjustable piston stem 54 and the end of the piston 32 to also provide an inherent biasing force against the swashplate 28 in the on-stroke direction. The bias spring 53 is particularly useful when the swashplate angle is small, or when the pump is started and full pressure has not been attained to keep the swashplate 28 biased on-stroke. As previously indicated, the trunnion blocks 30 are positioned offset somewhat from the axis of the drive shaft 15 and, in FIG. 2, the offset is downward such that the tilt axis of the swashplate 28 is below the drive shaft axis. The result is an imbalance in the net force exerted by the compression springs 24 and the pump pistons 23 which also tends to bias the swashplate 28 on-stroke. The combination of the bias spring 53 in the on-stroking position 32 and the net offset reaction force of the piston springs 24 provides a simple pump start-up system.

The piston shoes 26 which must slide in a circular movement around the reaction surface 27 of the swashplate 28 are held in position by a retainer plate 55 provided with a number of holes equal to the number of pistons (e.g. 7) which surround the shoes 26 such that the peripheral edges of the retainer plate 55 defining the holes bear on the shoe faces in engagement with the reaction surface 27. The retainer plate 55 rotates with the rotor/piston assembly 20, 23 and is held by slidable engagement with a pair of oppositely disposed hold down brackets 58 which are L-shaped construction and are bolted to the opposite end faces of the swashplate 28. The ends of the off-stroking and on-stroking pistons 31 and 32, respectively, bear against forwardly extending, spaced cylindrical bearing members 60 and 61 which are bolted or otherwise attached to respective peripheral extremities 60*a*, 61*a* of the swashplate 28. The control pistons 31 and 32 are fixed in the cover plate 17. The cylindrical bearing members 60 and 61 provide full line contact with the control piston ends and yet accommodate the small amount of sliding movement occasioned by tilting of the swashplate 28.

The assembly of the prior art pump may be accomplished virtually entirely through the open end of housing 10, requires no access to the interior of the housing from the sides or opposite end, and results in precision alignment of the swashplate relative to the trunnion blocks 30. The roller bearings 14 are initially inserted into the hub 13 of the open housing 10 and secured therein with suitable snap rings 62 or the like. Before or after installation of the roller bearings 14, the trunnion blocks 30 are loosely attached to the flat inner surface 35 of the housing end wall 12, by threading mounting bolts (not shown) into the trunnion blocks 30 through mounting holes (not shown) in the end wall 12. The entire subassembly comprising the rotor 20, springs 24, pistons 23 with attached shoes 26, and swashplate 28 including retainer plate 55, hold down bracket 58 and bearing members 60, 61 are assembled held together against the bias of springs 24 and inserted into the open housing 10 with the drive shaft 15 extending through the hole 42 in the swashplate 28 and the central bore in the rotor 20. The cover plate 17 is then placed over the open end of the housing 10 with the opposite end of the drive shaft 15 received in the counter bore 16 in the center of the cover plate 17. When the subassembly including the swashplate 28 is inserted into the housing 10, the concave bearing surface 40 overlies the semi-cylindrical surfaces 33 of the trunnion blocks 30 and brings them into final exact coaxial alignment. After the cover plate 17 has been bolted down, the trunnion block mounting bolts are tightened from the outside of the end wall 12 to complete the assembly. A suitable shaft seal 63 may be inserted from the outside into the recess in the hub 13 surrounding the head of the drive shaft 15. It should be noted that the on-stroking and off-stroking pistons 31 and 32 are attached to the inside face of cover plate 17, before cover plate 17 is placed over the housing 10 to finally close the same. Each of the pistons 31 and 32 is held initially in the cover plate 17 by a threaded adjustment screw 64 and 65, respectively, on their ends.

While the axial piston pump above described has performed generally satisfactorily in most applications, the swashplate control system defined by the control pistons 31 and 32 and the particular location has been less than desirable. As described in the Background of the Invention, pistons 31 and 32 bear on opposite locations of the swashplate 28 to create a "teeter-totter" effect which tends to induce unreasonably high stresses and undesirable bending moments about the tilt axis of the swashplate 28.

Figure 1:
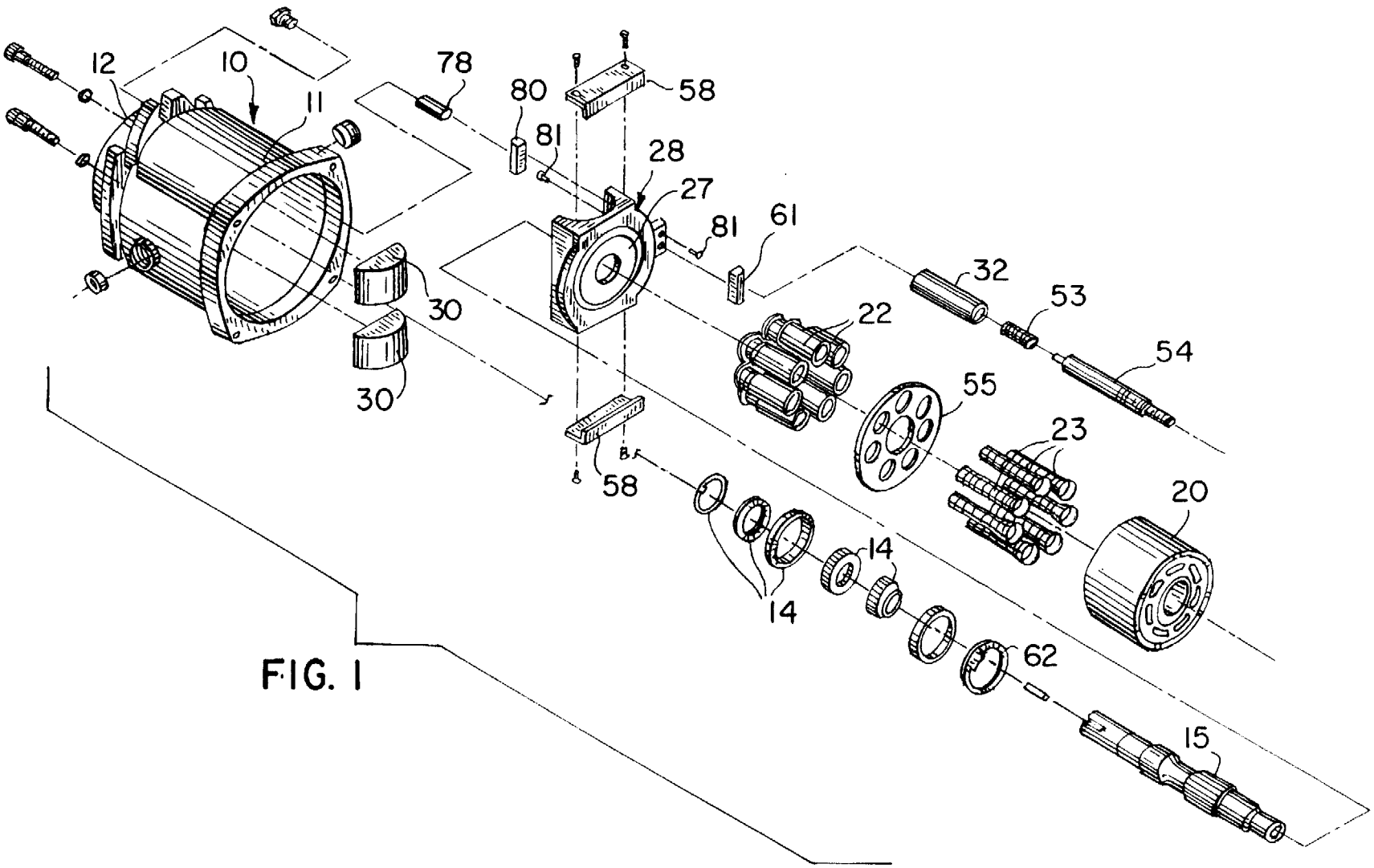
FIG. 1 is an exploded perspective view of the swashplate control system embodying the present invention.
Figure 3:
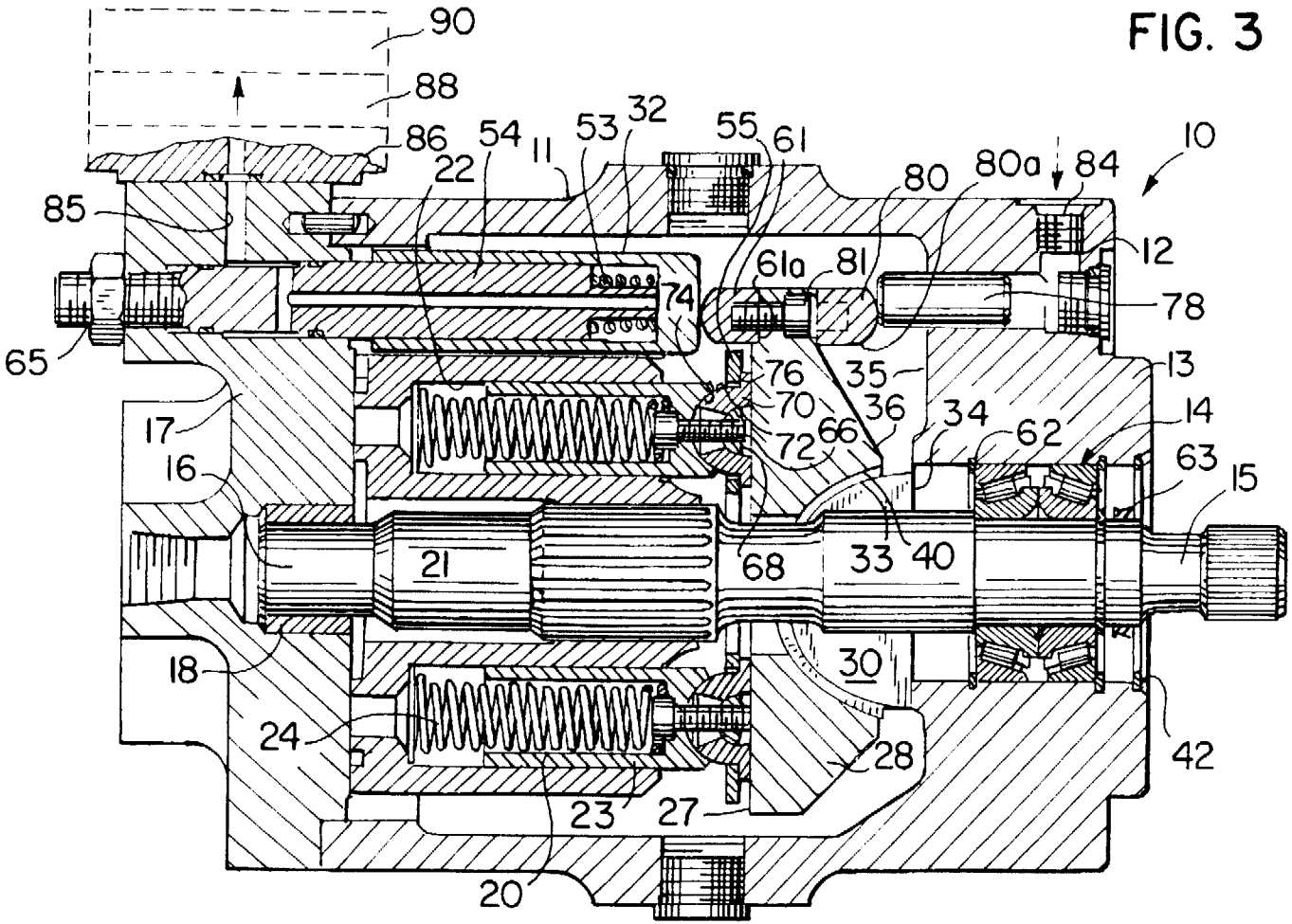
FIG. 3 is a vertical section through an axial piston pump illustrating the swashplate control system of the present invention with the swashplate at a neutral or zero position.
Figure 4:
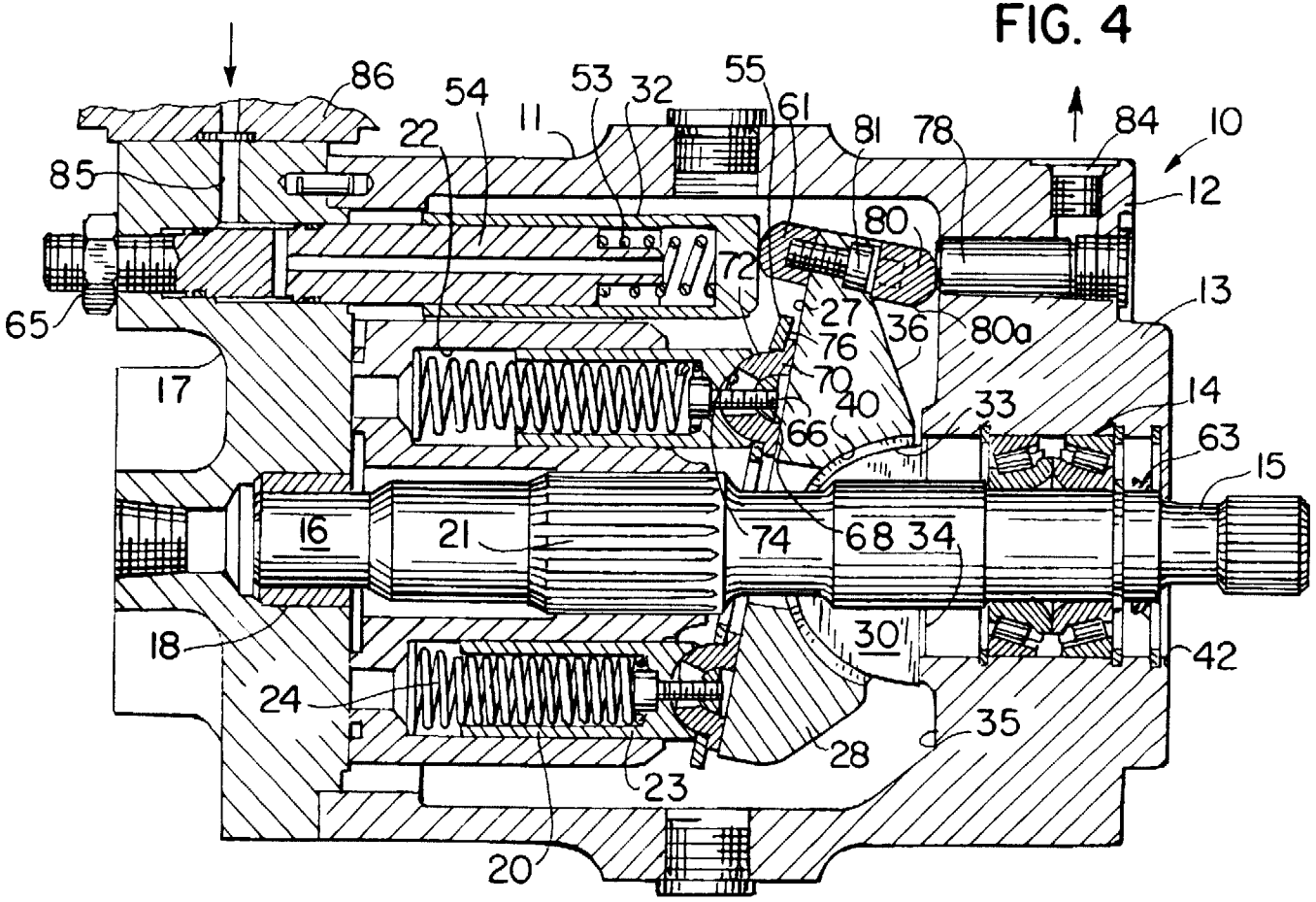
FIG. 4 is a sectional view similar to FIG. 3, but showing the swashplate control system with its swashplate tilted to a 10° position.

In contrast, an axial piston pump provided with the swashplate control of the present invention is depicted in FIGS. 1, 3 and 4. Like numerals are used to represent like elements previously described above with the following structural distinctions.

In the present invention, the outer ends of the pistons 23 are provided with horizontally disposed rivets 66 having semi-spherical rivet heads 68 about which a set of piston shoes 70 rotate. Each piston shoe 70 has a convex spherical portion 72 which slides in a concave recess 74 formed in the extreme outer end of the piston 23. In addition, each of the shoes 70 has a flat surface 76 opposite the spherical portion 72 which slidably engages the smooth flat reaction surface 27 on the swashplate 28.

In accordance with the present invention, the tilt of the swashplate 28 is controlled by a cooperating control piston arrangement acting in opposed relationship against the reaction surface 27 and the rear surface 36 of the swashplate 28 to eliminate the bending moments induced by the axially reciprocable pistons 23 and biasing means 24 about the tilt axis of the swashplate 28. In particular, the cooperating control piston arrangement includes a biasing piston 78 positioned in the end wall 12 of the housing 10 and bearing against a bearing member 80 attached to the rear surface 36 of the swashplate 28 at the peripheral extremity 80*a* thereof, and the control piston 32 positioned in the cover plate 17 and bearing against the bearing member 61 attached to the reaction surface 27 of the swashplate 28 at the peripheral extremity 61*a* thereof in opposed relationship to the biasing piston 78. Bearing members 61 and 80 are preferably removably attached to the swashplate 28 by fasteners 81. The control piston 32 has a first pressure actuated surface area which is larger than a second pressure actuated surface area on the biasing piston 78.

In the preferred embodiment, the diameter of the control piston 32 is approximately twice as large as the biasing piston 78, and both the control piston 32 and the biasing piston 78 lie on the same centerline. This particular arrangement has been found to substantially eliminate any bending moments induced by the axial piston springs 24 and control pistons 78, 32 about the tilt axis of the swashplate 28 as experienced in prior art pumps having control pistons acting on the same reaction surface 27. Eliminating this high stress problem allows one to use a smaller swashplate 28, trunnion blocks 30 and pump housing 10. It should be understood, however, that the diametric relationship of the control pistons 78, 32 and their axial alignment may be varied as desired.

Volume control in the pump of the present invention is provided internally by the biasing or volume control piston 78 also referred to as the off-stroking piston because of its tendency to bias the swashplate 28 towards a no flow position of FIG. 3, and the opposite control or pressure compensating piston 32 which is also referred to as an on-stroking piston which is biased to tilt the swashplate 28 towards the full or maximum flow position of FIG. 4. The off-stroking piston 78 receives high pressure system fluid from the pump outlet port through suitable porting 84. Similarly, pressure compensating piston 32 receives high pressure fluid through suitable outlet porting 85. In the preferred embodiment, a pressure compensating regulator valve 86 feeds the porting 85. Other control devices such as a torque limiter 88 or a load sensing control 90 may be stacked one on top of the other, as shown in phantom in FIG. 3. Alternatively, the control devices may be used in lieu of the valve 86.

The assembly of the pump of the present invention differs from the assembly of the prior art pump described above in that the biasing piston 78 and the control piston 32 are attached to the end wall 12 of housing 10 and the inset face of cover plate 17, respectively, before cover plate 17 is placed over the housing 10 to finally close the same.

Figure 5:
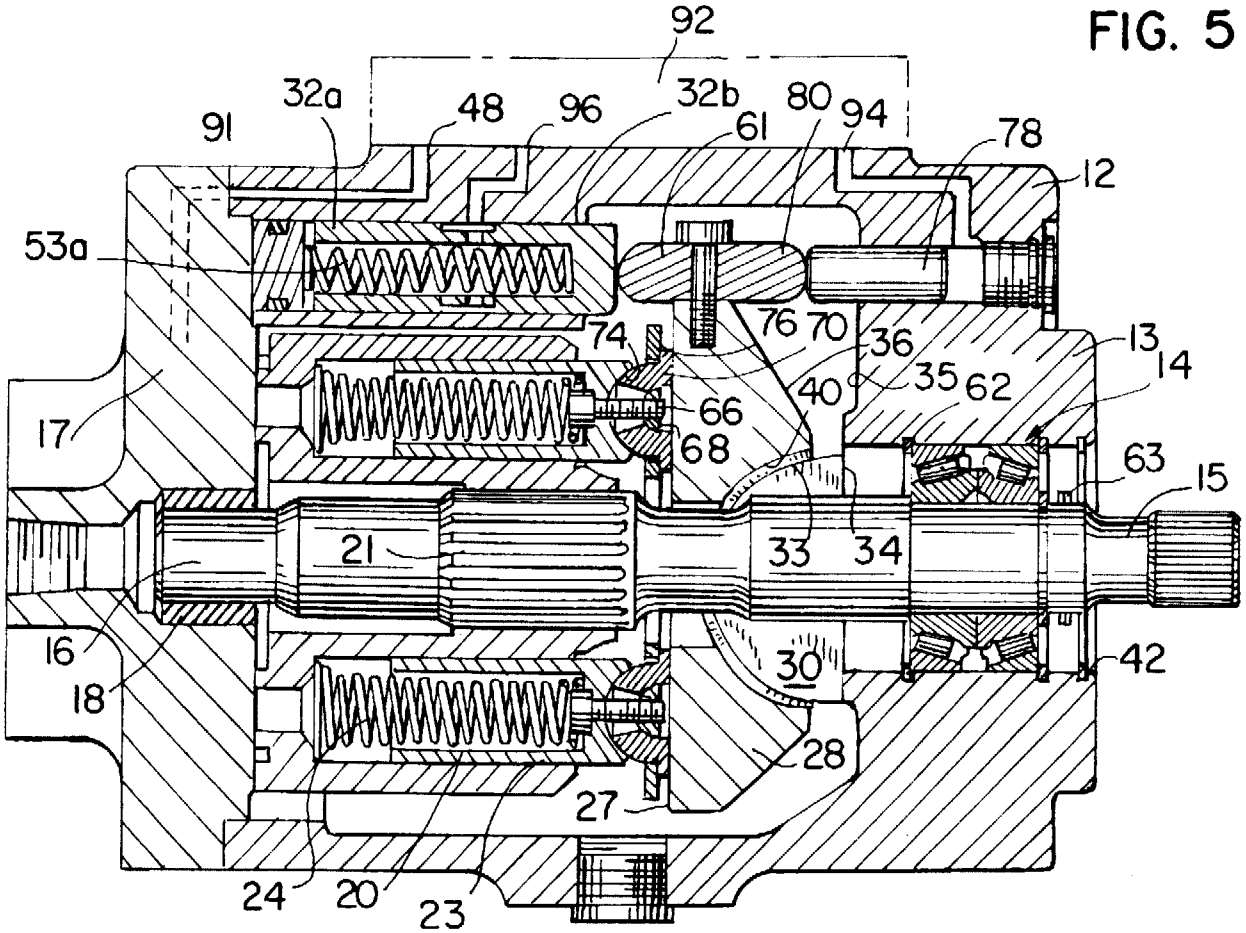
FIG. 5 is a sectional view like FIG. 3 showing a first alternative embodiment.

FIG. 5 shows a first alternative embodiment in which piston 32 and piston stem 54 are replaced by a two part piston 32*a*, 32*b* mounted in the housing 10 (rather than cover plate 17). Biasing spring 53*a* extends between an inside face of piston 32*b* and a plug 91 against which cover plate 17 faces. Fluid pressure control is administered by a two way, three position control element 92, which supplies constant pressure via channel 94 to piston 78, supplies control pressure via channel 96 on piston 32*a* to stroke and de-stroke the pump, and admits supply pressure via channel 98 from the high pressure port. All other aspects of the invention remain as described above.

Figure 6:
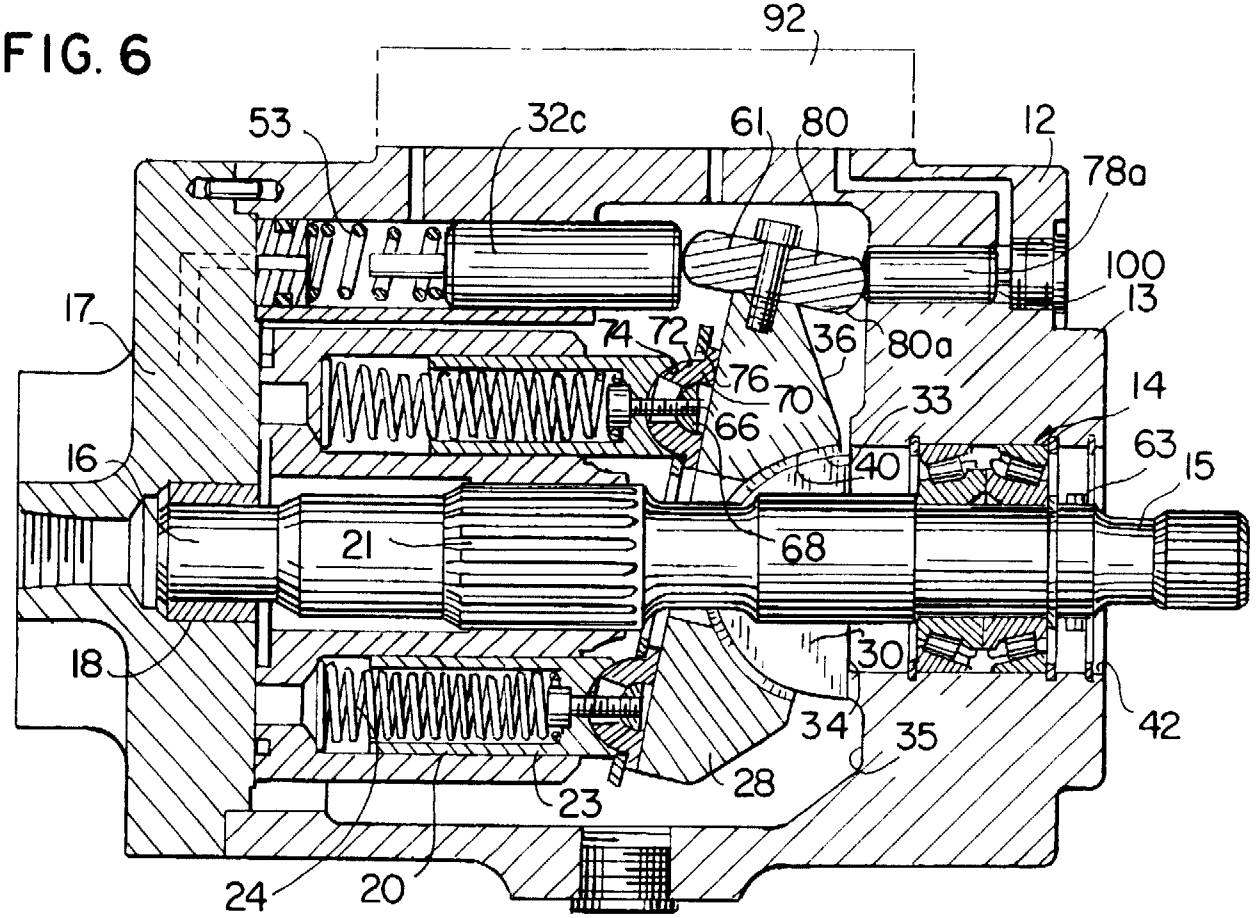
FIG. 6 is a sectional view like FIG. 4 showing a second alternative embodiment.

FIG. 6 shows a second alternative embodiment in which piston 32 and piston stem 54 are replaced by an integral piston stem 32*c*. Spring 53 acts between a backside of piston stem 32*c* and the plug 91. Piston 78 is replaced by a piston 78*a* having a spring 100 acting on its backside which now has a larger pressure responsive surface area than cooperating piston stem 32*c*. Fluid pressure connections enable pistons 32*c*, 78*a* of this version to act opposite to those versions of FIGS. 3–5.

It should now be understood that the present invention provides a swashplate control system which substantially relieves the loading from the tilt axis of the swashplate normally created by the control pistons of prior art axial piston pumps. As a result of this construction, the design of the axial piston pump may be made appreciably more compact without sacrificing performance or complicating assembly.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

I claim:

1. A method of assembling an axial piston pump comprising the steps of:

a) providing a pump housing having an outer wall defining a generally cylindrical interior, a closed end wall with a drive shaft opening therein disposed on the axis of the housing, and an opposite open end;

b) providing a first piston positioned in the end wall of the housing;

c) providing a second piston positioned in the pump housing;

d) attaching a pair of trunnion blocks to the end wall on opposite sides of the opening, the block having alignable outer bearing surfaces to provide a common axis extending transverse to the housing axis;

e) rotatably mounting a drive shaft on the axis of the housing with one end of the shaft general to the drive shaft opening;

f) providing a swashplate having a rear bearing surface on one side, the bearing surface having a radius slightly greater than the radius of the outer bearing surface of the trunnion blocks, a smooth planar reaction surface opposite the rear bearing surface, and a drive shaft hole in the center of the swashplate extending through the bearing surface and the reaction surface;

g) providing a piston subassembly including a rotor housing having a central drive shaft engaging bore and a plurality of circumferentially spaced, axially disposed cylinders surrounding the bore, axially reciprocable pistons disposed in the cylinders and having piston ends extending outwardly from the cylinders in the same direction, and biasing means for urging the pistons axially in the same direction;

h) inserting the swashplate piston subassembly into the housing through the open end, around the drive shaft, with the rear bearing surface against the outer bearing surfaces of the trunnion blocks to allow the swashplate to tilt thereon such that the axis of the rear bearing surface provides a tilt axis coincident with the common axis of the outer bearing surfaces, the drive shaft received in and extending through the rotor bore and driving arrangement therein and with the piston heads in biased slidable rotational engagement with the reaction surface;

i) providing a cover plate having a centrally disposed bearing means for rotatably supporting the other end of the drive shaft and means for engaging the rotor housing and holding and maintaining the bias engagement between the piston ends and the swashplate reaction surface; and j) closing the open end of the pump housing with the cover plate such that the first piston engages the rear surface of the swashplate and the second piston engages the reaction surface of the swashplate in opposed relationship to the first piston.

* * * * *